United States Patent [19]

Urso, Jr.

[11] Patent Number: 4,695,152

[45] Date of Patent: Sep. 22, 1987

[54] CHARGE ERASE DEVICE FOR AN ELECTROPHOTOGRAPHIC PRINTING MACHINE

[75] Inventor: Charles J. Urso, Jr., Webster, N.Y.

[73] Assignee: Xerox Corporation, Stamford, Conn.

[21] Appl. No.: 798,370

[22] Filed: Nov. 18, 1985

Related U.S. Application Data

[63] Continuation of Ser. No. 676,030, Nov. 28, 1984, abandoned.

[51] Int. Cl.[4] ..... G03G 15/00

[52] U.S. Cl. ..... 355/3 R; 355/14 E; 355/67; 313/572

[58] Field of Search ..... 355/3 R, 3 ER, 14 E, 355/67–69, 1; 313/112, 572, 573, 576, 637, , 643

[56] References Cited

U.S. PATENT DOCUMENTS

| | | | |
|---|---|---|---|
| 2,487,437 | 11/1949 | Goldstein et al. | 313/573 X |
| 3,498,714 | 3/1970 | Elmer | 355/70 |
| 3,581,140 | 5/1971 | Paquette | 313/111 |
| 3,679,928 | 7/1972 | Johnson | 313/112 |
| 3,792,913 | 2/1974 | Simmons | 355/7 |
| 4,008,954 | 2/1977 | Ogawa et al. | 355/3 R |
| 4,226,522 | 10/1980 | Marshall | 355/1 |
| 4,226,523 | 10/1980 | Ovshinsky et al. | 355/1 |
| 4,255,042 | 3/1981 | Armitage, Jr. et al. | 355/3 R |
| 4,260,250 | 4/1981 | McCormick-Goodhart | 355/113 |
| 4,319,830 | 3/1982 | Roach | 355/68 X |
| 4,461,981 | 7/1984 | Saikatsu et al. | 313/643 X |
| 4,477,908 | 10/1984 | Sheng et al. | 372/88 |

FOREIGN PATENT DOCUMENTS 56-159679 12/1981 Japan .

OTHER PUBLICATIONS

"The Fluorescence of Phosphors in Rare Gases", by N. C. Beese, *Journal of the Optical Society of America,* vol. 36, No. 9, Sep. 1946, pp. 493–498.

*Primary Examiner*—Arthur T. Grimley
*Assistant Examiner*—J. Pendegrass

[57] ABSTRACT

Neon lamps are disclosed which are used to modify previously formed charge levels on the surface of a photoconductive member. The lamps have cold cathode electrodes sealed into its opposite ends and are filled with neon at a pressure range of from 18 to 25 torr.

2 Claims, 6 Drawing Figures

CHARGE ERASE DEVICE FOR AN ELECTROPHOTOGRAPHIC PRINTING MACHINE

This is a continuation of application Ser. No. 676,030, filed Nov. 28, 1984 now abandoned.

This invention relates generally to an electrophotographic printing machine wherein a photoreceptor surface is charged to an appropriate level and subsequently exposed to form a latent image of a document thereon. More particularly, the invention relates to an illumination device for removing unwanted charge from the photoreceptor surface.

Generally, the process of electrophotographic printing includes charging a photoconductive member to a substantially uniform potential so as to sensitize the surface thereof. The charged portion of the photoconductive surface is exposed to a light image of an original document being reproduced. This records an electrostatic latent image on the photoconductive member corresponding to the informational areas contained in the original document. After the electrostatic latent image is recorded on the photoconductive member, the latent image is developed by bringing a developer mixture into contact therewith. This forms a powder image on the photoconductive member which is subsequently transferred to a copy sheet. Finally, the powder image is permanently affixed to the copy sheet in image configuration.

A problem with many prior art printing machines is that areas outside of the exposed document image retain their original charge and are subsequently developed. These areas include edge margins as well as areas between subsequent document images (interdocument gaps). These unwanted development areas must be removed from the photoreceptor surface prior to the next charge and expose cycle. It is known in the art to use erase lamps which are periodically energized to illuminate these predetermined areas. The intensity and spectral output of the lamps is adapted so that the charge level in the illuminated zone is reduced below the operating threshold level of the developing system, thus preventing development. These prior art lamps, typically C-Blue fluorescent lamps, are a relatively expensive component requiring a costly power supply. They suffer from other deficiencies such as startup delays, stability through temperature variations and illumination fall-off at the ends. An illumination source which avoids these problems is a rare gas lamp wherein a rare gas such as neon or xenon replaces the mercury of the fluorescent lamp system. These lamps have found application for use such as display signs but have not yet found application as a charge reduction device in an electrophotographic printing machine. A rare gas lamp has advantages particularly useful in a printing environment; it has "instant startup" characteristics and is more reliable in operation than a fluorescent lamp. It requires a much lower power level and is drastically lower in cost than the fluorescent lamp. Despite these advantages, the rare gas lamps have not heretofore found use in printing machines, primarily because the operating life of this type of lamp has not proved adequate. Printing machines of the type disclosed herein require lamps having operating lives of thousands of hours to meet reliability and maintenance standards. Heretofore it has not been possible to achieve this type of operating life with rare gas lamps while maintaining desired exposure levels.

The invention is therefore directed to a charge reduction system which utilizes a rare gas erase lamp designed to meet long life requirements. More particularly, the invention is directed towards an electrophotographic printing machine comprising: a photoconductive member, means for forming a charge on the surface of said member, means for exposing said surface so as to form a latent electrostatic image on said surface and means for reducing the charge in at least one region of said surface, said charge reduction means including a neon lamp comprising an elongated tubular glass envelope having electrodes sealed into its opposite ends and containing neon gas at a pressure range of 9–25 torr.

Other features of the present invention will become apparent as the following description proceeds and upon reference to the drawings, in which.

Figure 1:
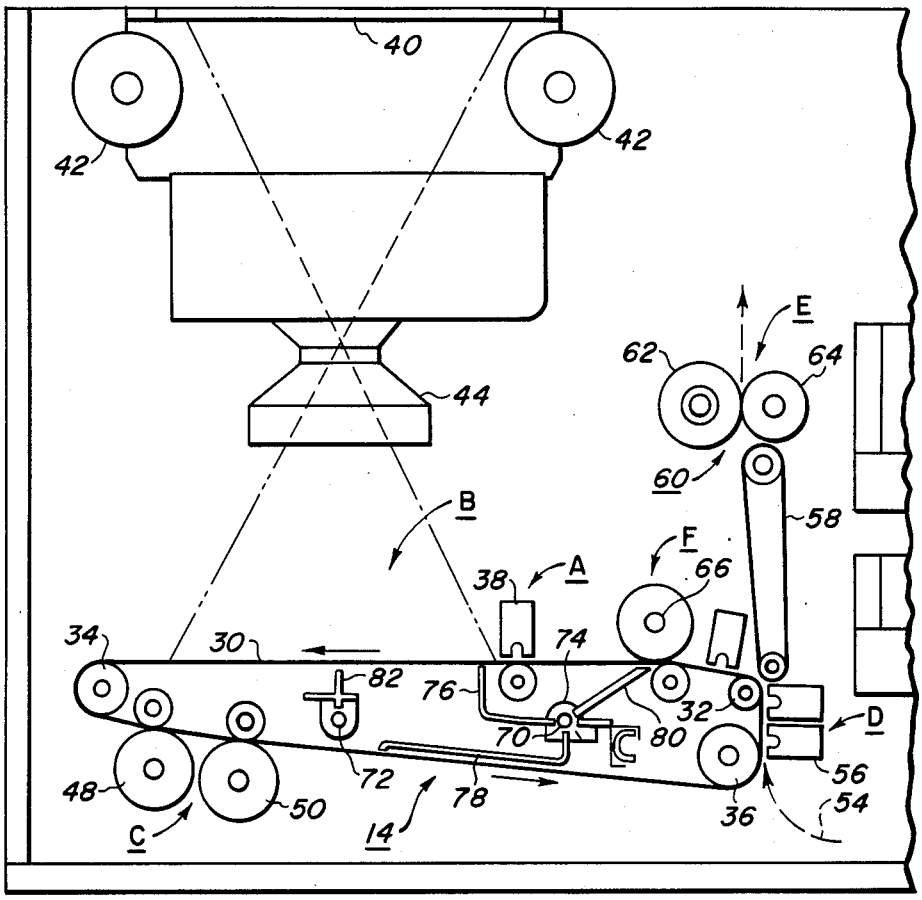
FIG. 1 is a perspective view illustrating an electrophotographic printing machine incorporating the charge erase device of the present invention therein.

For a general understanding of the features of the present invention, reference is made to the drawings. In the drawings, like reference numerals have been used throughout to designate identical elements. FIG. 1 is a perspective view illustrating an electrophotographic printing machine incorporating the features of the present invention therein. It will become apparent from the following discussion that the apparatus of the present invention is equally well suited for use in a wide variety of printing machines and is not necessarily limited in its application to the particular embodiments shown herein.

Turning now to FIG. 1, there is shown a side view of an illustrative electrophotographic printing machine incorporating the features of the present invention therein.

Inasmuch as the art of electrophotographic printing is well known, the various processing stations are shown schematically and their operation described briefly with reference to FIG. 1.

A processing module 14 employs a belt 30 having a photoconductive surface deposited on a conductive substrate. Preferably, belt 30 has characteristics disclosed in U.S. Pat. No. 4,265,990, whose contents are hereby incorporated by reference. Belt 30 advances successive portions of the photoconductive surface sequentially through the various processing stations disposed about the path of movement thereof. Belt 30 is entrained about stripping roller 32, tensioning roller 34, and drive roller 36. Drive roller 36 is coupled to a suitable motor (not shown) so as to rotate and advance belt 30 in the indicated direction.

Initially, a portion of belt 30 passes through charging station A. At charging station A, a corona generating device 38 charges the photoconductive surface of belt 30 to a relatively high, substantially uniform potential.

After the photoconductive surface of belt 30 is charged, the charged portion thereof is advanced through exposure station B. At exposure station B, an original document is placed on a transparent platen 40. Lamps 42 flash light rays onto the original document. The light rays reflected from the original document are transmitted through lens 44 forming a light image thereof. Lens 44 focuses the light image onto the charged portion of the photoconductive surface to selectively dissipate the charge thereon. This action records an electrostatic latent image on the photoconductive surface which corresponds to the informational areas contained within the original document.

After the electrostatic latent image has been recorded on the photoconductive surface of belt 30, belt 30 advances the latent image to development station C, a magnetic brush development system advances developer material into contact with the latent image. Preferably, the magnetic brush development system includes two magnetic brush developer rollers 48 and 50. Each roller advances developer material into contact with the latent image. These rollers form a brush of carrier granules and toner particles, extending outwardly therefrom. The latent image attracts the toner particles from the carrier granules forming a toner powder image on the latent image.

After the electrostatic latent image is developed, belt 30 advances the tone powder image to transfer station D. A sheet 54 of support material advances to transfer station D from a copy sheet stack (not shown). Transfer station D includes a corona generating device 56 which sprays ions onto the backside of the copy sheet. This attracts the toner powder image from the photoconductive surface to the copy sheet. After transfer, the copy sheet moves onto conveyor 58 which advances the sheet to fusing station E.

Fusing station E includes a fuser assembly, indicated generally by the reference numeral 60 which permanently affixes the transferred powder image to the copy sheet. Preferably, fuser assembly 60 comprises a heated fuser roller. In this manner, the toner powder image is permanently affixed to the copy sheet. After fusing, the copy sheet is advanced to an output tray (not shown).

As belt 30 continues to advance in the indicated direction, it moves past cleaning station F where a cleaning roll 66 removes unwanted developer particles from the surface of the belt.

The printing machine shown in FIG. 1 requires several charge reduction operations to facilitate particular functions. A precharge erase is required to remove any charge remaining on the belt subsequent to the cleaning operation. An interdocument erase function is required to erase the charged strip between successive document images. A pretransfer erase function reduces the attraction between the developed image and the belt surface and facilitates transfer of the developed image, and an edge erase function is required to remove unwanted charge from the edge margins of an image.

These functions are performed by a pair of neon erase lamps 70, 72 constructed and operated according to the principles of the invention. These lamps, as shown in FIG. 1, are positioned within the interior space encompassed by light transmissive belt 30. Lamp 70 contained within a cavity 74, is optically coupled to light pipe guides 76, 78, 80. Each of these light guides provides charge reduction illumination to a specific portion of belt 30.

Light guide 76 branches into two end portions, each with a width sufficient to erase the charge on the margins of the image areas. Light guide 78 provides the illumination to assist the transfer function. Light guide 80 provides the illumination to assist the cleaning function. Lamp 70 will normally be in an energized state throughout the machine operation and is adapted to provide from 300–600 ergs/cm$^2$ at the charged surface.

Lamp 72 is optically coupled to light guide 82. The output end of guide 82 extends across the width of the belt. Lamp 72 is periodically energized for a time, and for a duration sufficient to erase the charge level in this space between subsequent document image areas. Lamp 72 provides an erase level of about 50 ergs/cm$^2$ at the interdocument surface.

Figure 2:
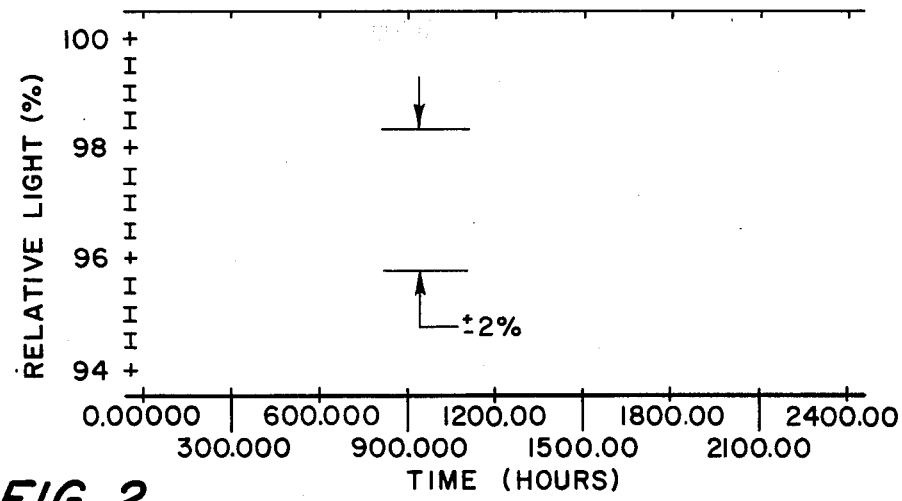
FIG. 2 is a graph showing life testing of a lamp constructed and operated according to the principles of the present invention.
Figure 3:
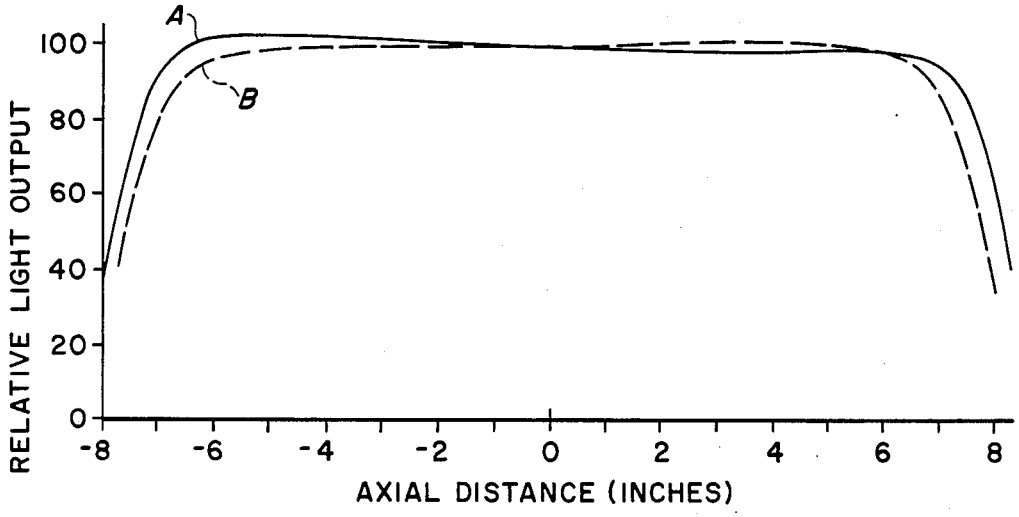
FIG. 3 is a graph showing the illumination profile of the charge reduction lamp both before and after life testing.
Figure 4:
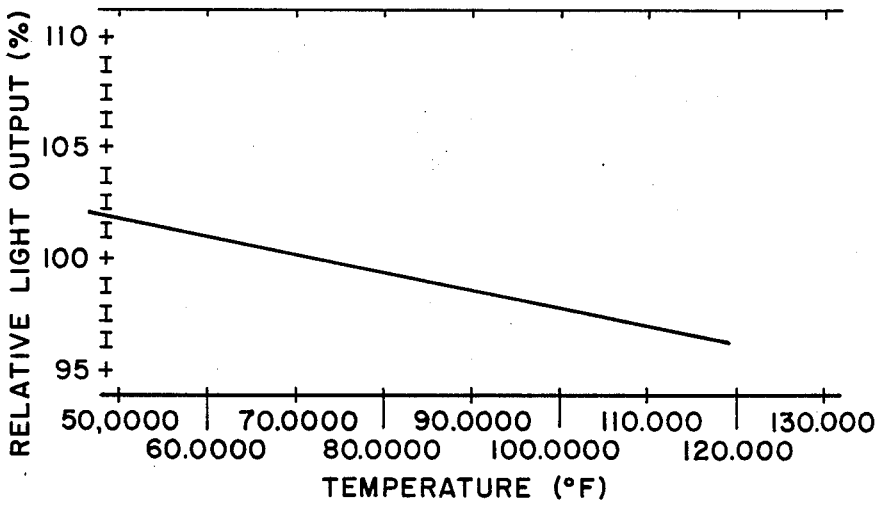
FIG. 4 is a graph showing the changes in relative light output over a temperature range.
Figure 6:
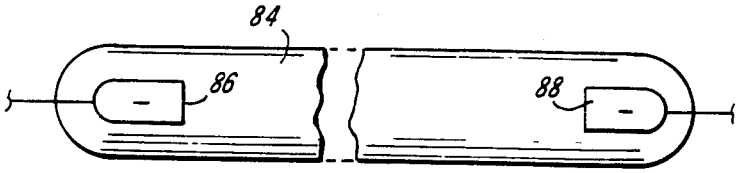
FIG. 6 is a side view of a cold cathode lamp operating as the charge erase device of FIG. 1.

Lamps 70, 72, in a preferred embodiment as shown in FIG. 6, comprise an elongated glass envelope 84 containing therein, under vacuum pressure, 100% neon gas cold cathode electrodes 86, 88. The lamps are, 10 mm in diameter and 485 mm in length. The lamps are operated a a pressure of 21 torr and at an operating current of between 10 and 50 ma (rms) but preferably at 35 ma. Operated under these conditions, lamps 70, 72 have been found to exhibit life characteristics which far exceed those possible with conventional fluorescent lamps or with previous rare gas lamps at lower pressures. They have been found to maintain excellent stability both over a long operating time as well as a varying temperature environment. They also possess instant-on characteristics. FIGS. 2–4 are graphs drawn to illustrate these characteristics.

FIG. 2 is a graph showing relative light output of the lamps over an operating life of 2400 hours. The lamp input power was 10 watts at 30 ma; ambient temperature was 25° C. The output of the lamp was measured at a distance of 250 mm from the axial centerline of the lamp. The light output is shown in nominal units but, for the system shown, was capable of averaging 350 ergs/cm$^2$ and remained within ±2% variation over the operating life.

FIG. 3 is a graph showing lamp axial uniformity. The axial irradiance was measured at a point 20 mm from the lamp surface. Plot A shows the profile of the neon lamp before the life test; plot B shows the profile after the life test. Both lamps exhibit very little illumination drop-off at the ends and only a small drop for the life-tested lamps as compared to the new lamp.

FIG. 4 is a graph showing changes in relative output with respect to operating temperatures ranging from 60° to 110° F. The lamps exhibited an output stability within ±5%, well within the range required by commercial printing machines.

Figure 5:
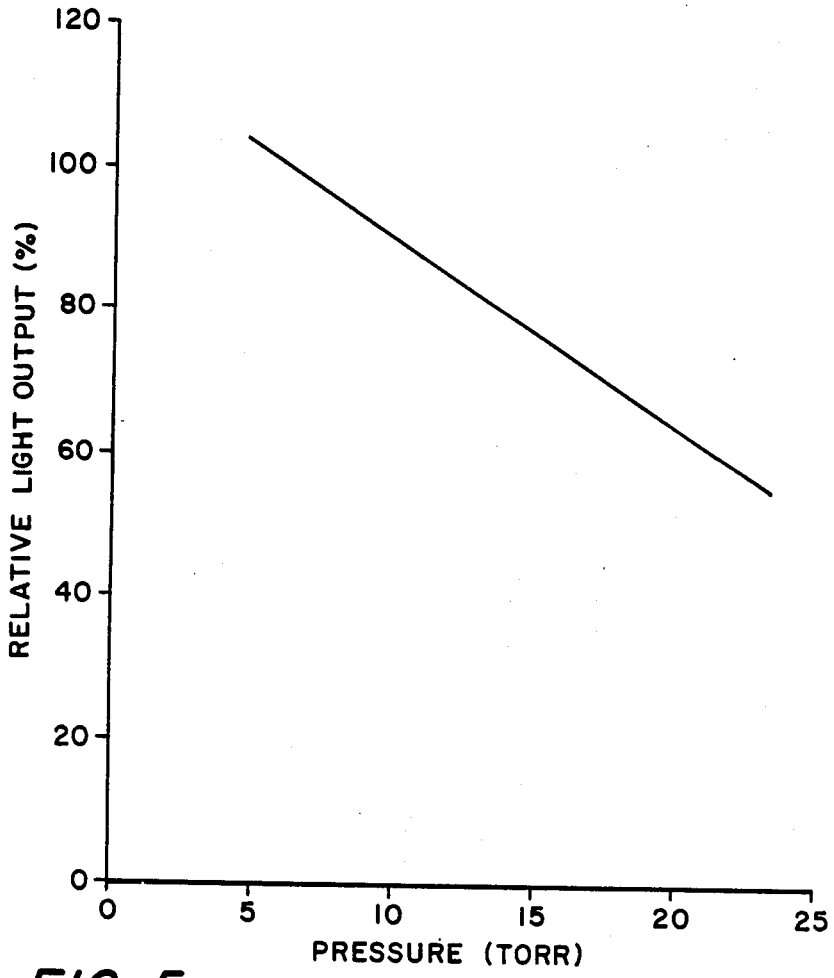
FIG. 5 is a graph showing the changes in reflective light output over a pressure range.

According to one aspect of the invention, it has been found that operating the lamps at relatively high pressure levels significantly contribute to the operating life of the lamp. The tradeoffs in operating at this pressure (higher starting voltage, lower light output) as shown in FIG. 5, have been found to be acceptable since light output is sufficient for the required erase purposes and the long life of the lamp more than compensates for the slightly reduced efficiency (when compared to operation at lower levels). As an example, a neon lamp conforming to lamps 70, 72 in all respects, except at a pressure of 9 torr, had an operating life of 250 hours. A range of lamp pressures, from 9 to 21 torrs, has been found to provide satisfactory life performance for most printing machine requirements.

In conclusion, while an exemplary embodiment of the charge reduction lamp has been described herein, it is contemplated that further variations and modifications within the purview of those skilled in the art can be made herein. For example, while the preferred embodiment is a 100% neon gas lamp, a small addition (approximately 1%) of another such as xenon may be used. For purposes of the invention, the lamp envelope should be substantially near 100% neon consistent with this small incremental modification. As a second example, while the lamps 70, 72 shown in FIG. 1, are of the nonfilament type; a second embodiment of the lamps may include "hot" filament lamps to increase brightness levels.

What is claimed is:

1. An electrophotographic printing machine comprising: a photoconductive member; means for forming a charge on the surface of said member, means for exposing said surface so as to form a latent electrostatic image on said surface and means for reducing the charge in at least one region of said surface, said charge reduction means including at least one lamp, said lamp comprising an elongated tubular glass envelope having cold cathode electrodes sealed into its opposite ends and containing neon at a pressure range of 18–25 torr, said lamp operating over a current range of 5 to 50 ma(rms);

wherein said lamp operates at a current of approximately 35 ma (rms) and at a pressure range of approximately 21 torr.

2. A neon lamp for modifying a charge level at the surface of a photoconductive member, said lamp comprising an elongated tubular glass envelope having cold cathode electrodes sealed into its opposite ends and containing neon at a pressure range of 18–25 torr;

wherein said lamp operates at a current of approximately 35 ma and at a pressure range of approximately 21 torr.

* * * * *